US007959866B2

(12) United States Patent
Crawford et al.

(10) Patent No.: US 7,959,866 B2
(45) **Date of Patent: *Jun. 14, 2011**

(54) COLLECTION ASSEMBLY

(75) Inventors: Jamieson W. M. Crawford, Demarest, NJ (US); Norman J. Hutton, Franklin Lakes, NJ (US); Margie M. Ferguson, East Orange, NJ (US); Michael Iskra, Bridgewater, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 1489 days.

This patent is subject to a terminal disclaimer.

(21) Appl. No.: 10/494,594

(22) PCT Filed: Aug. 29, 2003

(86) PCT No.: PCT/US03/27124

§ 371 (c)(1),
(2), (4) Date: May 5, 2004

(87) PCT Pub. No.: WO2004/022234

PCT Pub. Date: Mar. 18, 2004

(65) Prior Publication Data

US 2005/0000962 A1 Jan. 6, 2005

(51) Int. Cl.
*B01L 3/00* (2006.01)

(52) U.S. Cl. ..... 422/102; 220/23.83; 220/23.87; 220/23.89

(58) Field of Classification Search ..... 422/61, 422/68.1, 102, 547; 220/23.83, 23.86, 23.87, 220/23.89

See application file for complete search history.

(56) References Cited

U.S. PATENT DOCUMENTS

| | | | |
|---|---|---|---|
| 2,072,630 | A | 3/1937 | Ferry |
| 2,492,152 | A | 12/1949 | Hollowell |
| 3,039,648 | A | 6/1962 | Busch |
| 3,225,954 | A | 12/1965 | Herrick et al. |
| 3,578,197 | A | 5/1971 | Taylor et al. |
| 3,807,955 | A | 4/1974 | Note, Jr. et al. |
| 4,192,429 | A | 3/1980 | Yerman |
| 4,473,161 | A | 9/1984 | Zimmerman |
| 4,501,360 | A | 2/1985 | Levy et al. |
| 4,578,588 | A | 3/1986 | Galkin |
| 4,738,827 | A | 4/1988 | Pierotti |
| 4,746,017 | A | 5/1988 | Howard et al. |
| 4,756,407 | A | 7/1988 | Larsen |
| 4,771,911 | A | 9/1988 | Morony et al. |
| 4,830,217 | A | 5/1989 | Dufresne et al. |
| 4,865,014 | A | 9/1989 | Nelson |
| 4,869,812 | A | 9/1989 | Schoendorfer et al. |

(Continued)

FOREIGN PATENT DOCUMENTS

| | | | |
|---|---|---|---|
| EP | 0245994 | A2 | 11/1987 |

(Continued)

*Primary Examiner* — Jill Warden
*Assistant Examiner* — Dwayne K Handy
(74) *Attorney, Agent, or Firm* — The Webb Law Firm

(57) ABSTRACT

A tube assembly includes an inner tube telescoped into an outer tube. The inner tube is dimensioned to define a substantially annular space between the inner and outer tubes. Portions of the inner tube near its open top are configured to permit venting as the inner tube is inserted into the open top. However, the vent is closed during insertion of a closure into the tube assembly or prior to inserting a closure into the tube assembly.

29 Claims, 14 Drawing Sheets

U.S. PATENT DOCUMENTS

| | | | | |
|---|---|---|---|---|
| 4,873,193 | A | 10/1989 | Jensen et al. | |
| 4,878,597 | A | 11/1989 | Haast | |
| 4,919,985 | A | 4/1990 | Asai et al. | |
| 4,942,966 | A | 7/1990 | Kemp | |
| 4,967,919 | A | 11/1990 | Earhart | |
| 5,000,804 | A | 3/1991 | Nugent | |
| 5,019,243 | A | 5/1991 | McEwen et al. | |
| 5,055,258 | A | 10/1991 | Brodt et al. | |
| 5,096,062 | A | 3/1992 | Burkardt et al. | |
| 5,158,750 | A | 10/1992 | Finicle | |
| 5,160,704 | A | 11/1992 | Schluter | |
| 5,167,929 | A | 12/1992 | Korf et al. | |
| 5,197,602 | A | 3/1993 | Biesecker et al. | |
| 5,215,102 | A | 6/1993 | Guirguis | |
| 5,232,111 | A | 8/1993 | Burns | |
| 5,326,535 | A | 7/1994 | Vogler et al. | |
| 5,377,854 | A | 1/1995 | Cusack | |
| 5,384,096 | A * | 1/1995 | Burns | 422/102 |
| 5,545,375 | A | 8/1996 | Tropsha et al. | |
| 5,699,923 | A | 12/1997 | Burns | |
| 5,711,446 | A | 1/1998 | Jeffs et al. | |
| 5,716,683 | A | 2/1998 | Harvey et al. | |
| 5,738,233 | A | 4/1998 | Burns | |
| 5,833,928 | A | 11/1998 | Ratajczak et al. | |
| 5,853,600 | A | 12/1998 | McNeal et al. | |
| 5,871,700 | A | 2/1999 | Konrad | |
| 5,888,831 | A | 3/1999 | Gautsch | |
| 5,906,744 | A | 5/1999 | Carroll et al. | |
| 5,924,594 | A | 7/1999 | Kelly | |
| 5,942,191 | A | 8/1999 | Conway | |
| 5,968,620 | A | 10/1999 | Harvey et al. | |
| 5,975,343 | A | 11/1999 | Kelly et al. | |
| 6,027,694 | A | 2/2000 | Boulton et al. | |
| 6,066,299 | A | 5/2000 | Lodge | |
| 6,083,761 | A | 7/2000 | Kedar et al. | |
| 6,277,331 | B1 | 8/2001 | Konrad | |
| 6,308,846 | B1 | 10/2001 | Muller | |
| 6,354,452 | B1 | 3/2002 | DeSalvo et al. | |
| 6,612,997 | B1 | 9/2003 | Hutton | |
| 6,651,832 | B1 | 11/2003 | Iskra | |
| 6,651,835 | B2 * | 11/2003 | Iskra | 220/23.87 |
| 6,749,078 | B2 * | 6/2004 | Iskra | 220/23.87 |
| 6,805,842 | B1 | 10/2004 | Bodner et al. | |
| 2002/0011492 | A1 | 1/2002 | Iskra | |
| 2002/0104840 | A1 | 8/2002 | Iskra | |
| 2004/0079753 | A1 | 4/2004 | Reichenbach et al. | |

FOREIGN PATENT DOCUMENTS

| | | | |
|---|---|---|---|
| EP | 0735921 | B1 | 10/1998 |
| EP | 0901821 | A2 | 3/1999 |
| EP | 1175941 | A2 | 1/2002 |
| JP | 8-289881 | A | 11/1996 |
| JP | 9-507037 | T | 7/1997 |
| JP | 2003-153884 | A | 5/2003 |
| WO | 0154816 | A1 | 8/2001 |

* cited by examiner

COLLECTION ASSEMBLY

BACKGROUND OF THE INVENTION

1. Field of the Invention

The invention relates to a collection container assembly that includes a plurality of nested containers formed from different respective materials and provides an effective barrier against water and gas permeability and for extending the shelf-life of assembly.

2. Description of the Related Art

Plastic tubes have an inherent permeability to water transport due to the physical properties of the plastic materials used to manufacture the tubes. Therefore, it is difficult to maintain the shelf-life of plastic tubes that contain a liquid additive. It is also appreciated that deterioration of the volume and concentration of the liquid additive may interfere with the intended use of the tube.

In addition, plastic tubes that are used for blood collection require certain performance standards to be acceptable for use in medical applications. Such performance standards include the ability to maintain greater than about 90% original draw volume over a one-year period, to be radiation sterilizable and to be non-interfering in tests and analysis.

Therefore, a need exists to improve the barrier properties of articles made of polymers and in particular plastic blood collection tubes wherein certain performance standards would be met and the article would be effective and usable in medical applications. In addition, a need exists to preserve the shelf-life of containers that contain liquid additives. The time period for maintaining the shelf-life is from manufacturing, through transport and until the container is actually used.

Some prior art containers are formed as an assembly of two or more nested containers. The nested containers are formed from different respective materials, each of which is selected in view of its own unique characteristics. Some nestable containers are dimensioned to fit closely with one another. Containers intended for such assemblies necessarily require close dimensional tolerances. Furthermore, air trapped between the two closely fitting nestable containers can complicate or prevent complete nesting. Some prior art container assemblies have longitudinal grooves along the length of the outer surface of the inner container and/or along the length of inner surface of the outer container. The grooves permit air to escape during assembly of the containers. However, the grooves complicate the respective structures and the grooved containers still require close dimensional tolerances.

Other container assemblies are dimensioned to provide a substantially uniform space at all locations between nested inner and outer containers. Air can escape from the space between the dimensionally different containers as the containers are being nested. Thus, assembly of the nestable containers is greatly facilitated. Additionally, the nestable containers do not require close dimensional tolerances. However, the space between the inner and outer containers retains a small amount of air and the air may be compressed slightly during final stages of nesting. Some such container assemblies are intended to be evacuated specimen collection containers. These container assemblies are required to maintain a vacuum after extended periods in storage. However, air in the space between the inner and outer containers is at a higher pressure than the substantial vacuum in the evacuated container assembly. This pressure differential will cause the air in the space between the inner and outer containers to migrate through the plastic wall of the inner container and into the initially evacuated space of the inner container. Hence, the effectiveness of the vacuum in the container assembly will be decreased significantly. These problems can be overcome by creating a pressure differential between the annular space and the inside of the inner container to cause a migration of air through the walls of the inner container. The inner container then is evacuated and sealed. This approach, however, complicates and lengthens an otherwise efficient manufacturing cycle.

SUMMARY OF THE INVENTION

The present invention is a container assembly comprising inner and outer containers that are nested with one another. The inner and outer containers both are formed from plastic materials, but preferably are formed from different plastic materials. Neither plastic material is required to meet all of the sealing requirements for the container. However, the respective plastic materials cooperate to ensure that the assembly achieves the necessary sealing, adequate shelf life and acceptable clinical performance. One of the nested containers may be formed from a material that exhibits acceptable gas barrier characteristics, and the other of the containers may be formed from a material that provides a moisture barrier. The inner container also must be formed from a material that has a proper surface for the specified clinical performance of the material being stored in the container assembly. Materials that exhibit good gas barrier characteristics may include: acrylic polymers and copolymers, including ABS, SAN; ethylene vinyl alcohol; polyesters; PET; PETG; PETN; PEN and engineered thermoplastics, including polycarbonate and blends thereof. Materials that exhibit good moisture or vapor barrier characteristics may include: polyoelfins, including polyethylene, polypropylene and copolymers thereof, cyclic olefin copolymers and chloro- and fluoropolymers, including PVDC, PVDF, PVF, EPF and ACLAR. Preferably, the inner container is formed from polypropylene (PP), and the outer container is formed from polyethylene terephthalate (PET).

The inner and outer containers of the container assembly preferably are tubes, each of which has a closed bottom wall and an open top. The outer tube has a substantially cylindrical side wall with a selected inside diameter and a substantially spherically generated bottom wall. The inner tube has an axial length that is less than the outer tube. As a result, a closure can be inserted into the tops of the container assembly for secure sealing engagement with portions of both the inner and outer tubes. The outer surface of the inner tube and the inner surface of the outer tube are dimensioned to substantially nest with one another.

The inner tube of the container assembly may be formed with a small hole through the cylindrical side wall of the inner tube at a location spaced slightly from the open top. The hole permits venting of air from the space between the inner and outer tubes as the inner tube is being slid into the outer tube. The closure of the assembly includes an internal portion that will telescope within portions of the inner and outer tubes near the top ends of the respective tubes. Thus, the closure will seal the small hole adjacent the open top of the inner tube.

A further embodiment of the subject invention provides an inner tube that is sufficiently smaller than the outer tube to provide a small annular gap between the inner and outer tubes. The small annular gap between the inner and outer tubes permits air to escape easily as the inner tube is being telescoped into the outer tube. The outer surface of the inner tube includes a bead extending partly around the outer tube at a location near the open top. The bead may be formed unitarily with the inner tube or may be applied to the inner tube by adhesive or the like. The outside diameter defined by the bead is substantially equal to the inside diameter defined by the outer tube. The bead does not define a complete annulus. Rather, at least one gap is defined in the bead. Air can escape readily from the space between the inner and outer tubes as the cross-sectionally small inner tube is being telescoped into the outer tube. A complete annular bead around the inner tube would prevent further escape of air as the inner tube approaches its final nested position within the outer tube. However, the small gap in the annular bead permits the escape of air as the inner tube approaches its final nested position within the outer tube. Thus, air in the small annular gap between the inner and outer tubes is at ambient pressure and will not define a high pressure area that is likely to migrate through the plastic material of the inner tube and into the space defined by the inner tube. After assembly, the inner tube is spun relative to the outer tube. Thus, a friction weld is created between the inner and outer tubes for securely sealing the space between the tubes.

Another embodiment of the subject invention provides an inner tube with an outside diameter that is sufficiently smaller than the inside diameter of the outer tube to define an annular gap therebetween. Thus, as with the previous embodiment, the inner tube can be telescoped readily into the outer tube without generating a region of compressed air between the inner and outer tubes. The closure of this assembly includes a short cylindrical wall dimensioned to telescope into the annular space between the inner and outer tubes at a location substantially adjacent the open top of the inner tube. Thus, the short cylindrical wall of the closure seals the space between the inner and outer tubes. The closure also includes an inner section disposed and dimensioned to seal with the inner circumferential surface of the inner tube. An alternate to this embodiment provides a closure with a radially aligned step to cover the open top of the annular space between the inner and outer tubes without entering the annular space between the inner and outer tubes. The closure of this embodiment also includes an inner portion to seal with the inner circumferential surface of the inner tube.

A further embodiment of the subject invention includes an inner tube with an outside diameter that is sufficiently smaller than the inside diameter of the outer tube to define an annular gap therebetween. Thus, as with the previous embodiment, the inner tube can be telescoped readily into the outer tube without generating a region of compressed air between the inner and outer tubes. Portions of the inner tube at locations near the open top include a circumferentially extending weakened region. The weakened region may be created by an annular groove extending around the outer circumferential surface of the inner tube. A similar annular groove may be formed around the inner circumferential surface at a location substantially aligned with the annular groove on the outer circumferential surface. The closure of this assembly includes a tapered region with a small diameter leading end that defines a diameter approximately equal to the inside diameter of the inner tube. The closure then widens to an outside diameter substantially equal to the inside diameter of the outer tube. The tapered configuration enables the closure to function as a wedge that causes the inner tube to deform outwardly as the closure is being urged into the open tops of the inner and outer tubes. Thus, the portions of the inner tube adjacent the open top will flare outwardly and will be urged tightly against the inner circumferential surface of the outer tube as the closure is being urged into the open tops of the nested tubes.

Still a further embodiment includes an inner tube that has an outside diameter less than the inside diameter of the outer tube. Accordingly, the inner tube can be inserted into the outer tube without generating compressed air in the annular space between the inner and outer tubes. Portions of the inner tube near the open top may be flared out to an outside diameter equal to or slightly greater than the inside diameter of the outer tube. The assembly of the inner tube into the outer tube may be carried out by an annular collar with an inside diameter slightly less than the outside diameter of the flared open top of the inner tube and with an outside diameter approximately equal to the inside diameter of the outer tube. The collar is forced over the flared top of the inner tube and hence reduces the diameter of the flared top slightly. The collar of the assembly device includes a notch that extends from a location below the flared top of the inner tube to a location above the inner tube. The notch functions as a vent that permits the escape of air as the inner tube is being telescoped into the outer tube. The assembly apparatus also includes a plunger dimensioned to telescope into the open top of the collar. Thus, the plunger will engage the top of the inner tube. As the inner tube reaches or approaches complete assembly within the outer tube, the collar is withdrawn up while the plunger is urged down. As a result, the collar separates from the flared open top of the inner tube, and the flared top resiliently expands into sealing engagement with the inner circumferential surface of the outer tube.

Another embodiment of the subject invention includes an inner tube with an outside diameter that is sufficiently less than the inside diameter of the outer tube to define an annular gap between the inner and outer tubes. Thus, as with the previous embodiments, the inner tube can be telescoped into a fully nested condition within the outer tube without creating compressed air in the annular space between the inner and outer tubes. The assembly of this embodiment further includes a retaining ring. The retaining ring is dimensioned to nest with and seal the space between the inner and outer tubes. The sealing can be facilitated by chamfering the outer top surface of the inner tube and/or forming the retaining ring with a taper.

DETAILED DESCRIPTION

Figure 1:
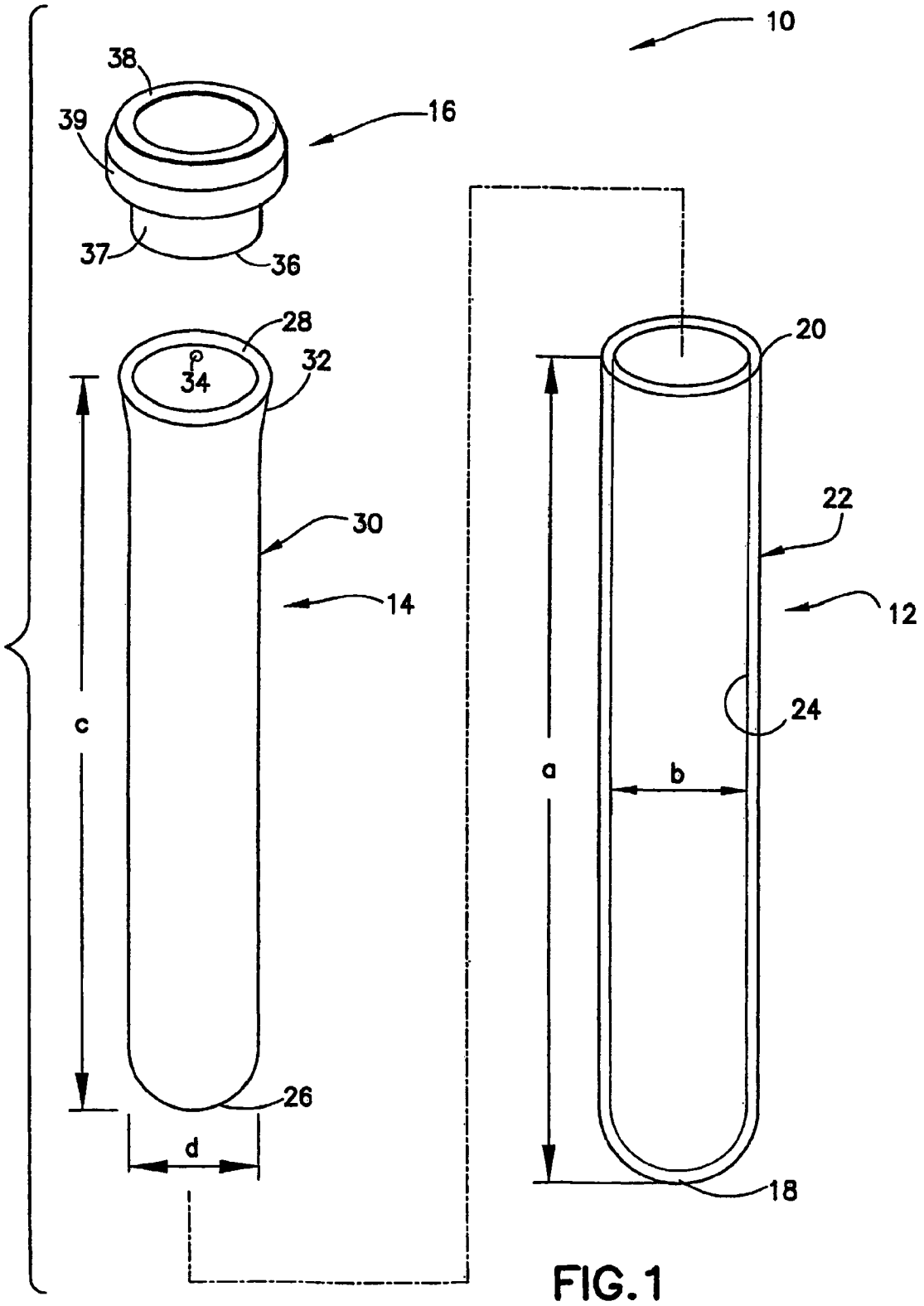
FIG. 1 is an exploded perspective view of a tube assembly in accordance with a first embodiment of the invention.

An assembly in accordance with a first embodiment of the subject invention is identified generally by the numeral 10 in FIGS. 1-5. Assembly includes an outer tube 12, an inner tube 14 and a closure 16.

Outer tube 12 is unitarily formed from PET and includes a spherically generated closed bottom wall 18, an open top 20 and a cylindrical wall 22 substantially extending therebetween. Outer tube 12 defines a length "a" from the interior of the bottom wall 18 to the open top 20. Side wall 22 of outer tube 12 includes a cylindrically generated inner surface 24 with an inside diameter "b". However, side wall 22 may taper slightly from open top 20 to closed bottom wall 18 to facilitate molding.

Inner tube 14 is formed unitarily from polypropylene and includes a spherically generated closed bottom wall 26, an open top 28 and a substantially cylindrical side wall 30 extending therebetween. Inner tube 14 defines an external length "c" that is less than internal length "a" of outer tube 12. However, side wall 30 may taper slightly from open top 28 to closed bottom wall 26 to facilitate molding. The extreme top of inner tube 14 includes an outwardly flared region 32 with a maximum outside diameter approximately equal to inside diameter "b" of side wall 22 on outer tube 12. Inner tube 14 is further characterized by a pin hole 34 that extends through side wall 30 of inner tube 14 at a location slightly below the outward flare 32.

Figure 4:
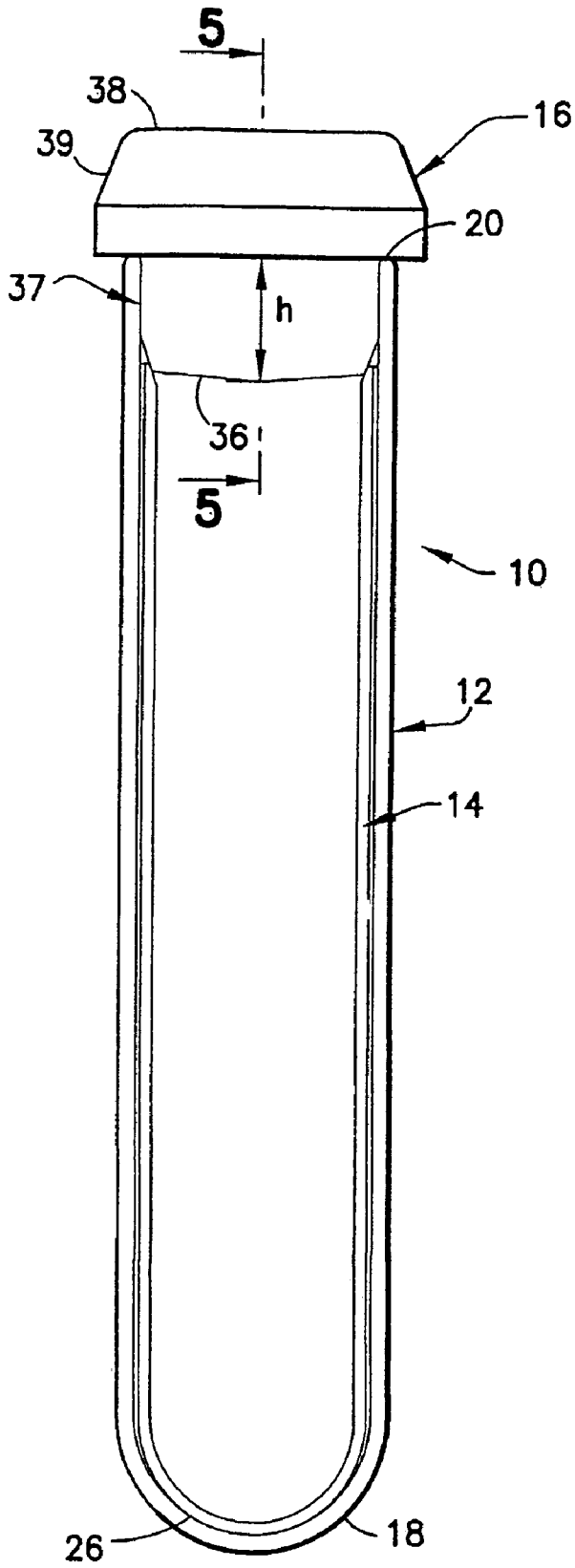
FIG. 4 is a side elevational view of the tube assembly of FIGS. 1-3 with the closure mounted to the inner and outer tubes.
Figure 6:
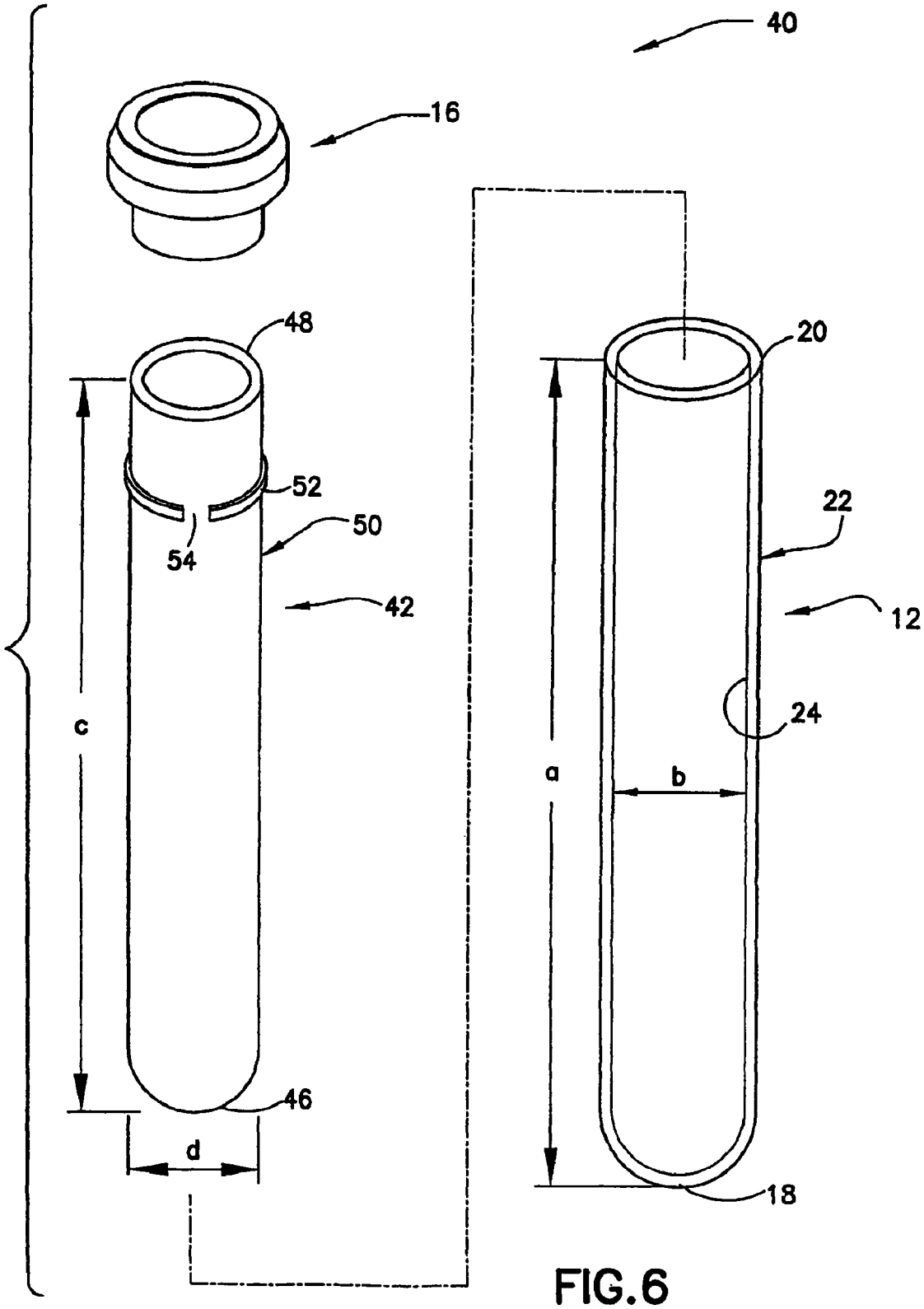
FIG. 6 is an exploded perspective view of a tube assembly in accordance with a second embodiment of the subject invention.
Figure 7:
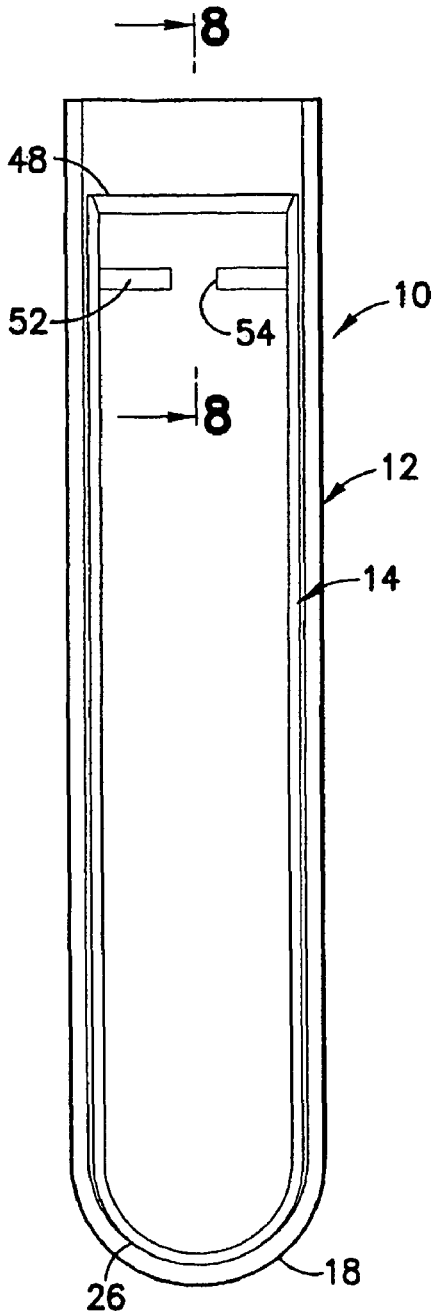
FIG. 7 is a side elevational view of the assembled tubes.
Figure 8:
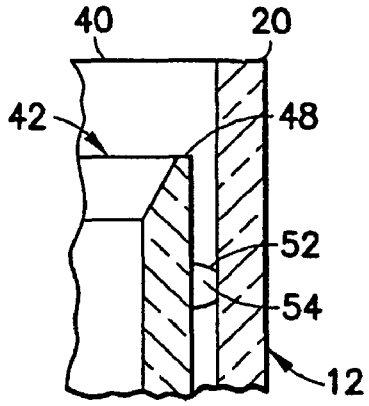
FIG. 8 is a cross-sectional view taken along line 8-8 in FIG. 7.
Figure 9:
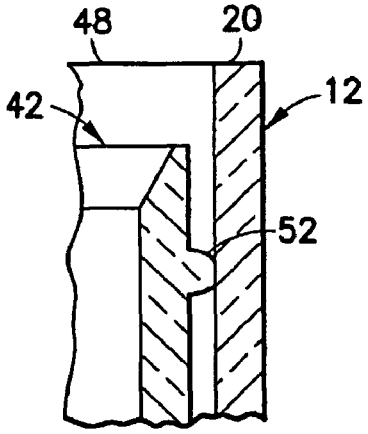
FIG. 9 is a cross-sectional view similar to FIG. 8, but showing a later stage during the assembly process.

Closure 16 preferably is formed from rubber and has a bottom end 36 and an internal section 37 adjacent bottom end 36. Closure 16 also has top end 38 and an external section 39 adjacent top end, as shown in FIG. 4. External section 46 is cross-sectionally larger than outer tube 12, and hence will sealingly engage against open top end 20 of outer tube 12. Internal section 37 includes a conically tapered lower portion and a cylindrical portion adjacent the tapered section 50. Internal section 37 defines an axial length "h" that is selected in view of the relative positioning of pin hole 34 in inner tube 12, as explained further below.

Figure 2:
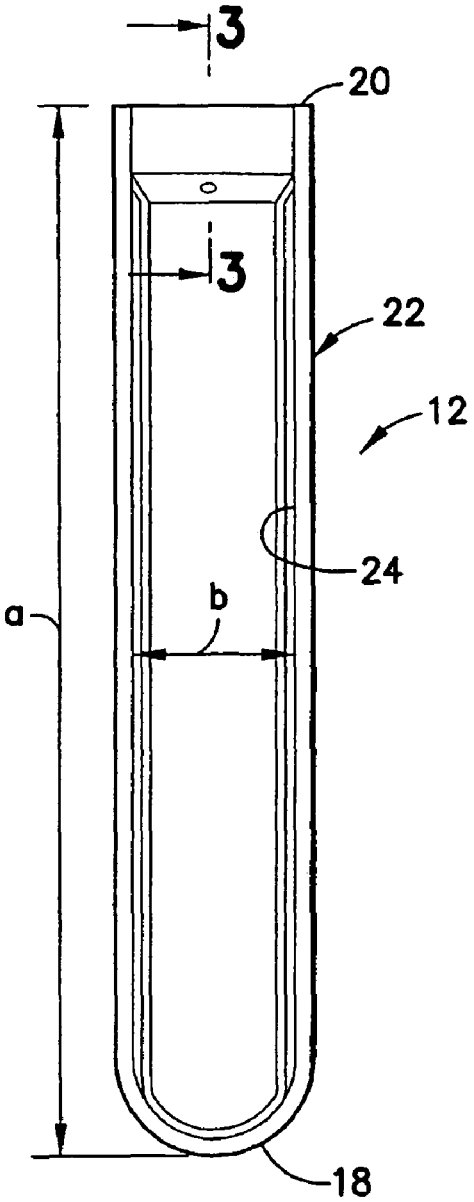
FIG. 2 is a side elevational view of the tube assembly of FIG. 1 shown in its assembled condition.
Figure 3:
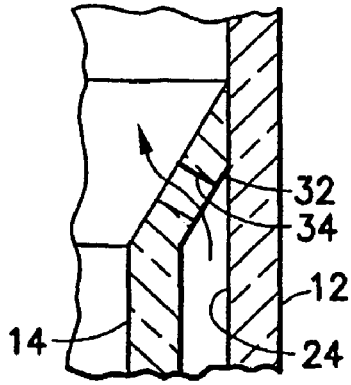
FIG. 3 is a cross-sectional view taken along line 3-3 in FIG. 2.
Figure 5:
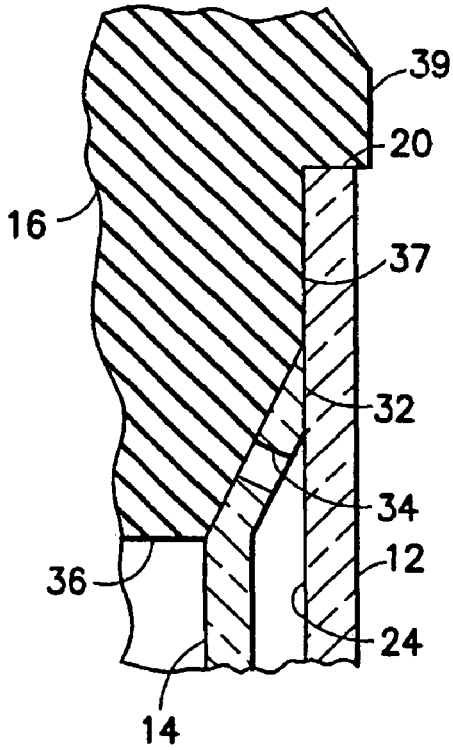
FIG. 5 is a cross-sectional view taken along line 5-5 in FIG. 4.

Assembly 10 is assembled by slidably inserting inner tube 14 into open top 20 of outer tube 12, as shown in FIGS. 2-4. Air in outer tube 12 will escape through the annular space between inner and outer tubes 12 and 14 while inner tube 14 is being nested within outer tube 12. However, the ability of air to escape in a pure axial direction will end when flare 32 slides into engagement with inner circumferential surface 24 of outer tube 12. However, air can continue to escape through pin hole 34 as inner tube 14 is moved toward its fully nested position. Hence, air remaining in the annular space between inner and outer tubes will be substantially at ambient pressure conditions and will not be in a compressed high pressure state. Accordingly, there will not be a great pressure differential between air within inner tube 12 and air trapped intermediate inner tube 14 and outer tube 12. As a result, migration of air through the plastic material of side wall 30 of inner tube 14 will not be great. Migration of air through side wall 30 of inner tube 14 can be reduced further by evacuating the space between inner tube 14 and outer tube 12. Specifically, the assembly of outer and inner tubes 12 and 14 can be placed in a low pressure environment. The pressure differential will cause air in the annular space between outer and inner tubes 12 and 14 to flow through pin hole 34.

The assembly of inner tube 14 with outer tube 12 can be sealed by closure 16. In particular, the tapered portion of internal section 37 facilitates initial insertion of closure 16 into open top 20 of outer tube 12. Sufficient axial advancement of closure 16 into open top 20 will cause cylindrical outer portion of internal section 37 to sealingly engage internal surface 24 of outer tube 12. Further insertion will cause the tapered portion of internal section 37 to sealingly engage the internal surface of inner tube 14 adjacent open top 28. Dimension "h" of internal section 37 is selected to ensure that internal section 37 seals pin hole 34 approximately when external section 35 abuts top end 20 of outer tube 12.

A second container assembly in accordance with the subject invention is identified generally by the numeral 40 in FIGS. 6-9. Assembly 40 includes an outer tube 12 and a closure 16 substantially identical to the outer tube and closure of the first embodiment. Assembly 40 further includes an inner tube 42 that has a closed bottom 46, an open top 48 and a tubular side wall 50 extending therebetween. Inner tube 42 is dimensionally similar to inner tube 14 of the first embodiment. However, inner tube 42 does not include an outwardly flared top comparable to the flared top 32 of the first embodiment. Instead, inner tube 42 includes a bead 52 extending partway around side wall 50 at a location spaced slightly below open top 48. A gap 54 is defined at at least one circumferential location on bead 52. Bead 52 may be formed unitarily with inner tube 42 or may be applied separately to inner tube 42 by adhesive or the like. Bead 52 defines an outside diameter "b" substantially equal to the inside diameter defined by tubular side wall 22 of outer tube 12.

Inner tube 42 can be telescoped within outer tube 12. The outside diameter of portions of inner tube 42 below bead 52 permit air to escape from outer tube 12 as inner tube 42 is urged into outer tube 12. Sufficient insertion of inner tube 42 within outer tube 12 will bring bead 52 into contact with inner surface 24 of side wall 22 on outer tube 12. This engagement between bead 52 and inner surface 24 will restrict the outflow of air from the space between inner and outer tubes 42 and 12. However, gap 54 in bead 52 will permit air to escape as inner tube 42 is moved into its final position. Accordingly, compressed air will not exist within container assembly 40. Closure 16 may be urged into the open tops of the nested inner and outer tubes 42 and 12 to seal the inside of both inner tube 42 and the annular space between inner and outer tubes 14 and 12.

Figure 10:
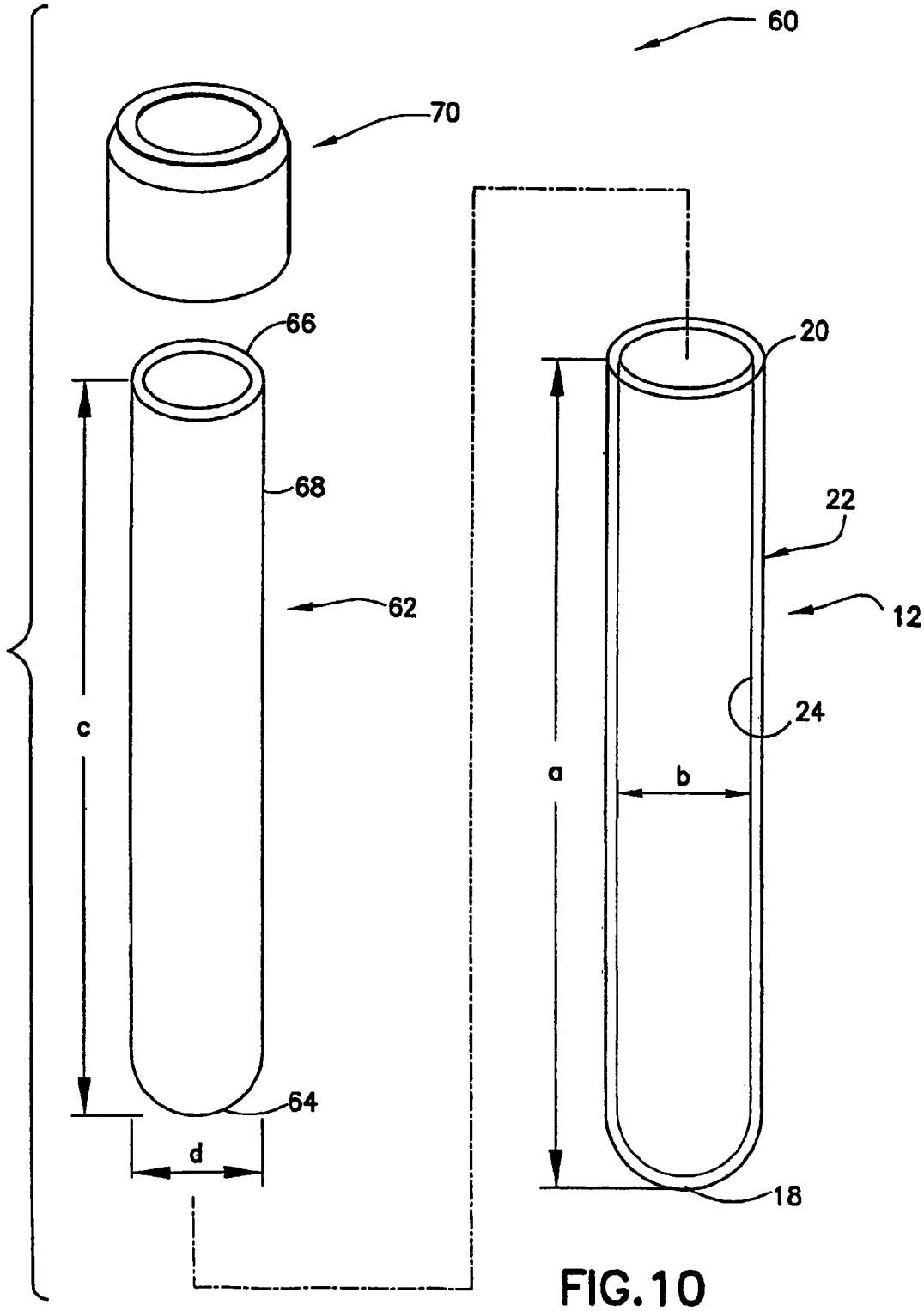
FIG. 10 is an exploded perspective view of a tube assembly in accordance with a third embodiment of the subject invention.
Figure 11:
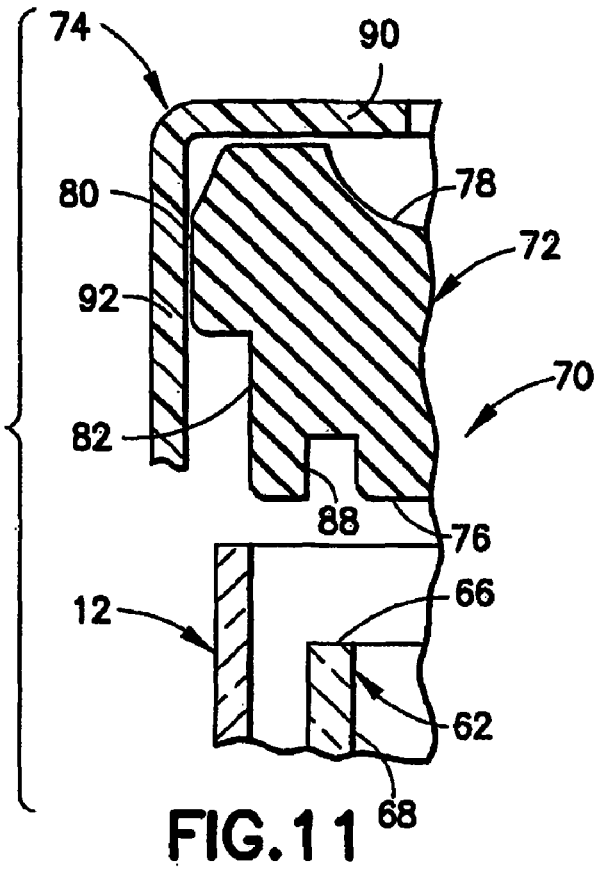
FIG. 11 is an exploded cross-sectional view of the closure disposed in proximity to the assembled tubes.
Figure 12:
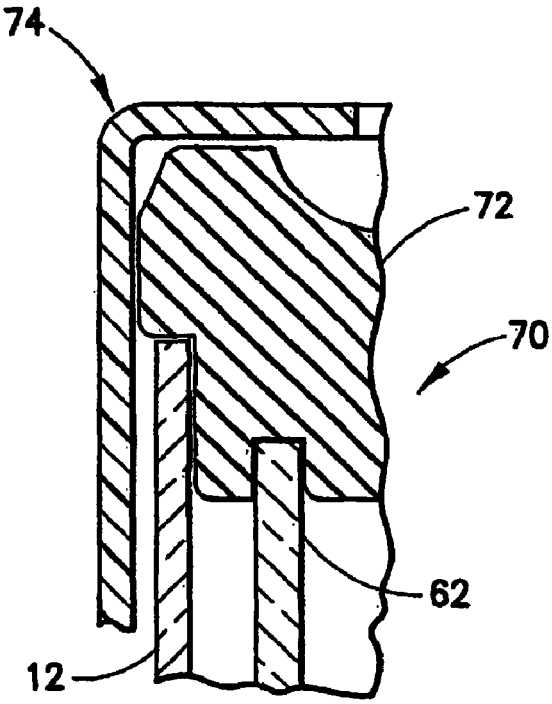
FIG. 12 is a cross-sectional view similar to FIG. 11, but showing the closure securely mounted to the assembled tubes.

A further embodiment of the subject container assembly is identified generally by the numeral 60 in FIGS. 10-12. Assembly 60 includes an outer tube 12 substantially identical to outer tube 12 described and illustrated with respect to the first embodiment. Assembly 60 further includes an inner tube 62 with a closed bottom 64, an open top 66 and a substantially cylindrical sidewall 68 extending therebetween. Side wall 68 has an outside diameter "d" that is sufficiently less than the inside diameter "b" of outer tube 12 to define an annular space between inner and outer tubes 62 and 12 in their assembled condition. Additionally, inner tube 62 defines an overall length "c" selected such that open top 66 of inner tube 62 is below open top 20 of outer tube 12 when inner tube 62 is nested completely within outer tube 12. Assembly 60 further includes a closure assembly 70.

Assembly 70 includes an inner closure 72 and an outer cap 74. Inner closure 72 is formed from an elastomeric material and has a bottom end 76 and a top end 78. Closure 72 includes an external section 80 extending down from top end 78. External section 80 is cross-sectionally larger than inner circumferential surface 24 of outer tube 12. Hence, external section 80 of closure 72 is dimensioned to sit on open top 20 of outer tube 12. Closure 72 further includes an internal section 82 extending up from bottom end 76. Internal section 82 defines an outside diameter slightly greater than inside diameter "b" of outer tube 12. Thus, internal section 86 is dimensioned to sealingly engage inner circumferential surface 24 of outer tube 12. Internal section 86 is formed further with an annular groove 88 extending up into bottom end 76. Groove 88 is spaced inwardly from the outer circumferential surface of internal section 86 by a distance substantially equal to the radial dimension of the annular gap between inner tube 62 and outer tube 12. Thus, as shown most clearly in FIG. 12, a portion of internal section 86 will enter and seal the annular gap between inner and outer tubes 62 and 12. Groove 88 defines a radial dimension approximately equal to the thickness of side wall 68 on inner tube 62. Hence, portions of internal section 86 of closure 80 will seal with both inner and outer surfaces of sidewall 68 of inner tube 62 adjacent open top 66 of inner tube 62. Groove 88 defines a depth sufficient for groove 88 to engage top end 66 of inner tube 62 substantially when external section 80 of closure 72 engages open top 20 of outer tube 12.

Cap 74 is of known construction and includes an annular top wall 90 for abutting top end 78 of closure 72. Cap 74 further includes a cylindrical skirt 92 that extends down from top wall 90. Skirt 92 is cross-sectionally dimensioned to frictionally engage the outer circumferential surface of external section 80 of closure 72. Skirt 92 is longitudinally dimensioned to extend down beyond external section 80 of closure 72.

Figure 13:
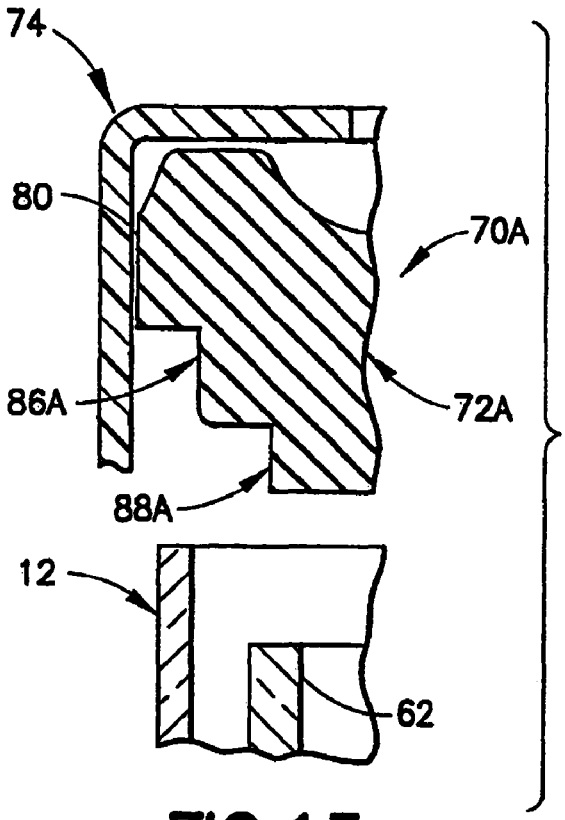
FIG. 13 is a cross-sectional view similar to FIG. 11, but showing an alternate closure.
Figure 14:
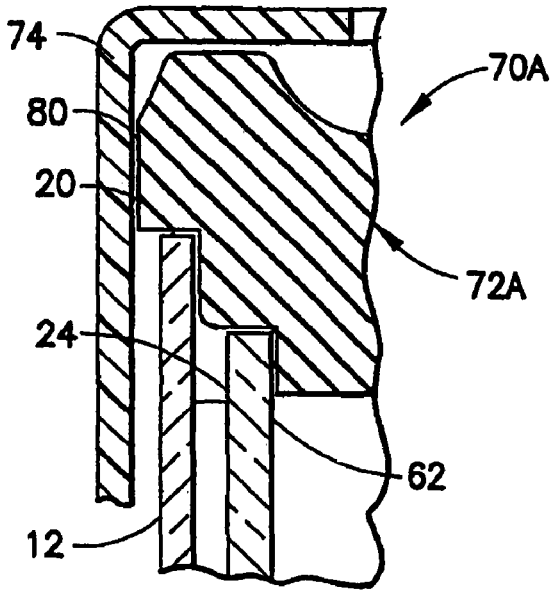
FIG. 14 is a cross-sectional view similar to FIG. 12, but showing the alternate closure.

FIGS. 13 and 14 show a closure assembly 70A that differs slightly from closure 70 described and illustrated with respect to FIGS. 11 and 12. Closure assembly 70A includes a cap 74 identical to cap 74 described and illustrated with respect to FIGS. 1 and 12. Assembly 70A further includes a closure 72A that is structurally and functionally very similar to closure 72. In particular, closure 72A includes an external section 80 identical to external section 80 of closure 72. Closure 72 further includes an internal section 86A that differs slightly from internal section 86 of closure 72. In particular, internal section 86A includes a rabbet groove 88A that extends entirely to the outer circumferential surface of internal section 86A. Thus, closure 72 does not include a section that will enter the annular space between inner tube 62 and outer tube 12. However, internal section 86A will cover the annular space between inner tube 62 and outer tube 12 and will sealingly engage both the internal surface 24 of outer tube 12, the internal surface of inner tube 62 and the top end 66 of inner tube 62. Additionally, the bottom end of external section 80 will seal against open top 20 of outer tube 12.

Figure 15:
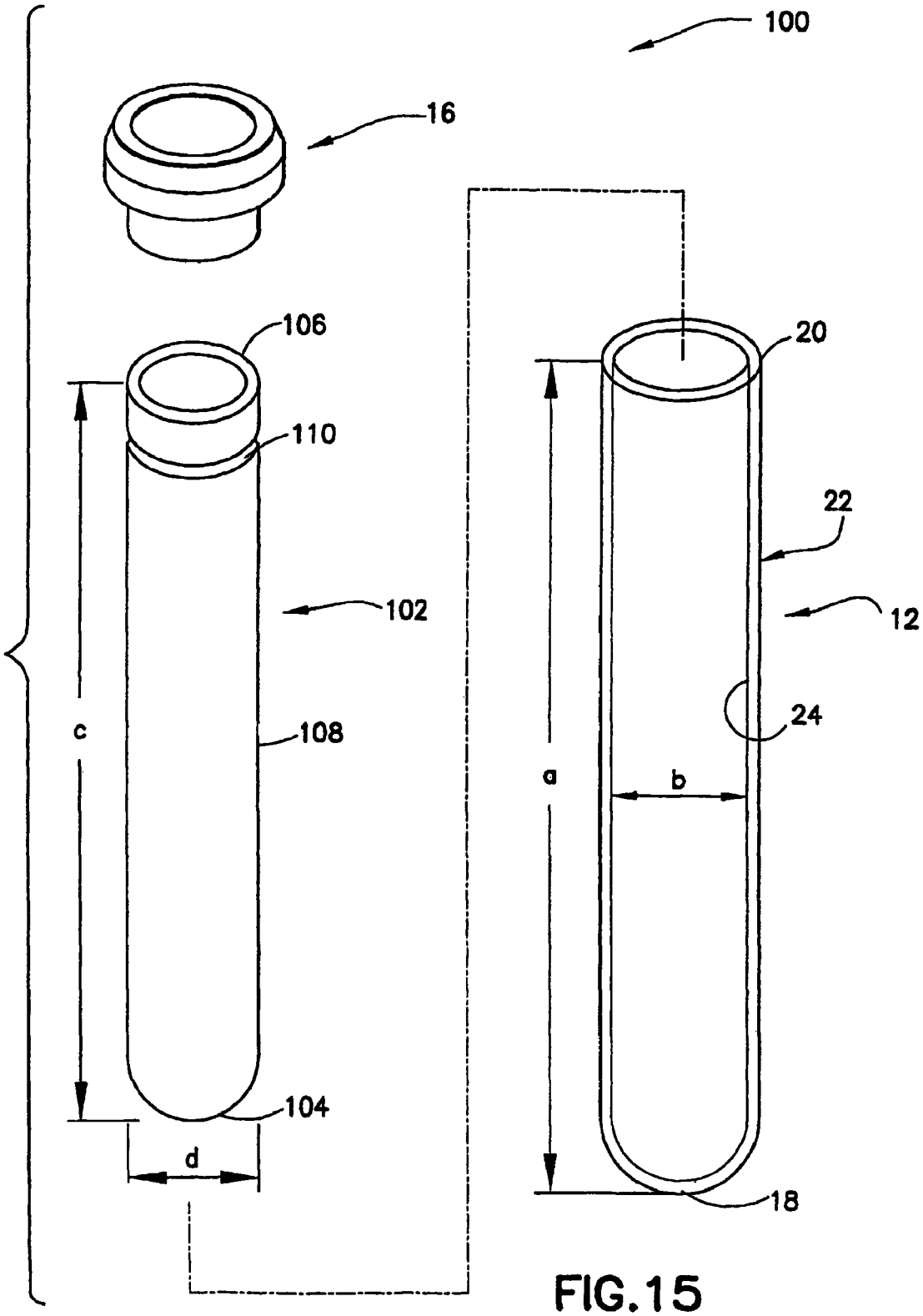
FIG. 15 is an exploded perspective view of a tube assembly in accordance with a fourth embodiment of the invention.
Figure 16:
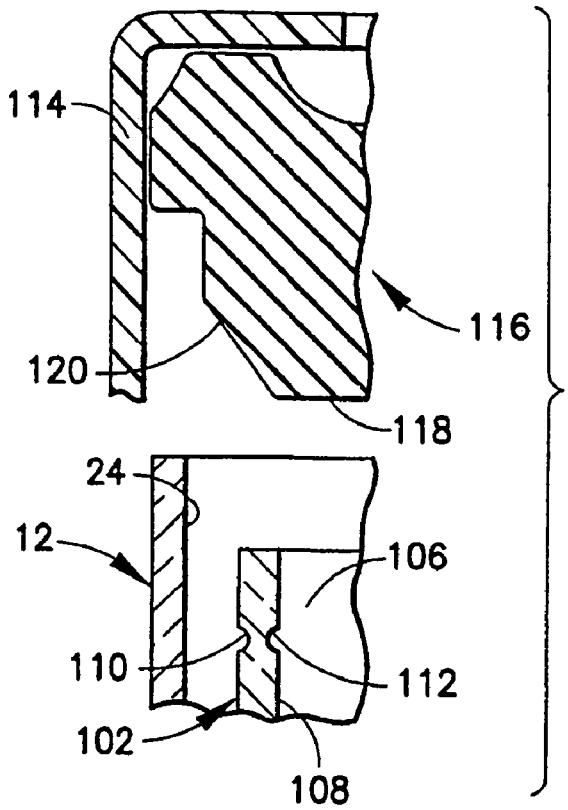
FIG. 16 is an exploded cross-sectional view showing a portion of the assembled tubes near their open top and a corresponding portion of the closure.
Figure 17:
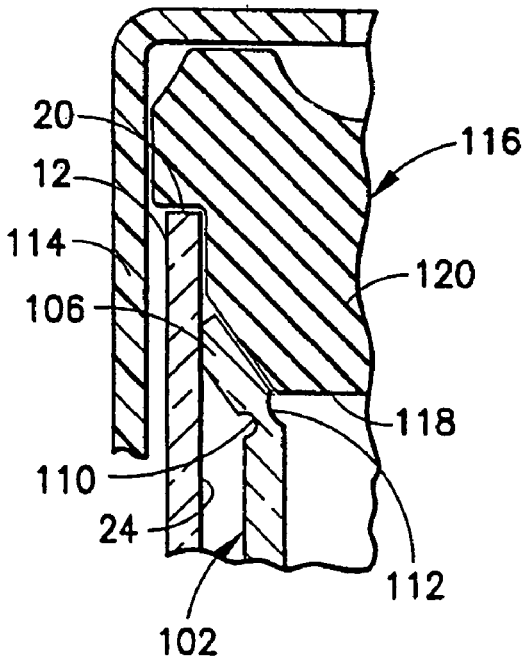
FIG. 17 is a cross-sectional view similar to FIG. 16, but showing the closure securely mounted to the assembled tubes.

A further embodiment of a container assembly in accordance with the subject invention is identified generally by the numeral 100 in FIGS. 15-17. Container assembly 100 includes an outer tube 12 substantially identical to the outer tube described and illustrated with respect to the first embodiment. Assembly 100 further includes an inner tube 102 with a closed bottom 104, an open top 106 and a generally cylindrical side wall 108 extending between bottom 104 and top 106. Side wall 108 defines an outside diameter "d" that is less than inside diameter "b" of outer tube 12. Thus, inner tube 102 can be telescoped easily within outer tube 112 so that an annular gap exists between inner tube 102 and outer tube 12. Accordingly, there will be no air compressed between inner tube 102 and outer tube 12.

Inner tube 102 is characterized by an annular groove 110 extending around the outer circumferential surface of side wall 108 at a location spaced slightly below open top 106. In the illustrated embodiment, a second annular groove 112 is formed around the inner circumferential surface of side wall 108 at a location aligned with groove 110. The grooves 110 and 112 weaken side wall 108 sufficiently to facilitate an outward flaring of side wall 108 at locations between open top 106 and grooves 110, 112.

Container assembly 100 further includes a closure assembly 114. Closure assembly 114 includes an outer cap 74 substantially identical to the outer cap 74 described and illustrated with respect to FIGS. 11-14. Assembly 114 further includes a closure 116 that is structurally and functionally similar to the closures described and illustrated with respect to FIGS. 11-14. However, closure 116 includes a bottom end 118 and a frustum-shaped section 120 adjacent bottom end 118. Frustum-shaped section 120 functions as a wedge that engages internal surface regions of inner tube 102 adjacent open top 106. As closure 116 is urged further into inner tube 102, frustum-shaped section 120 causes portions of side wall 108 adjacent open top 106 to deflect outwardly about grooves 110, 112 and into sealing engagement with inner circumferential surface 24 of outer tube 12. This sealing occurs well after inner tube 102 has been fully nested within outer tube 12. Hence, there is no compressed air in the annular space between inner and outer tubes 102 and 12. Closure 116 sealingly engages inner surface regions of both inner tube 102 and outer tube 12 adjacent the respective open tops 106 and 20.

Figure 18:
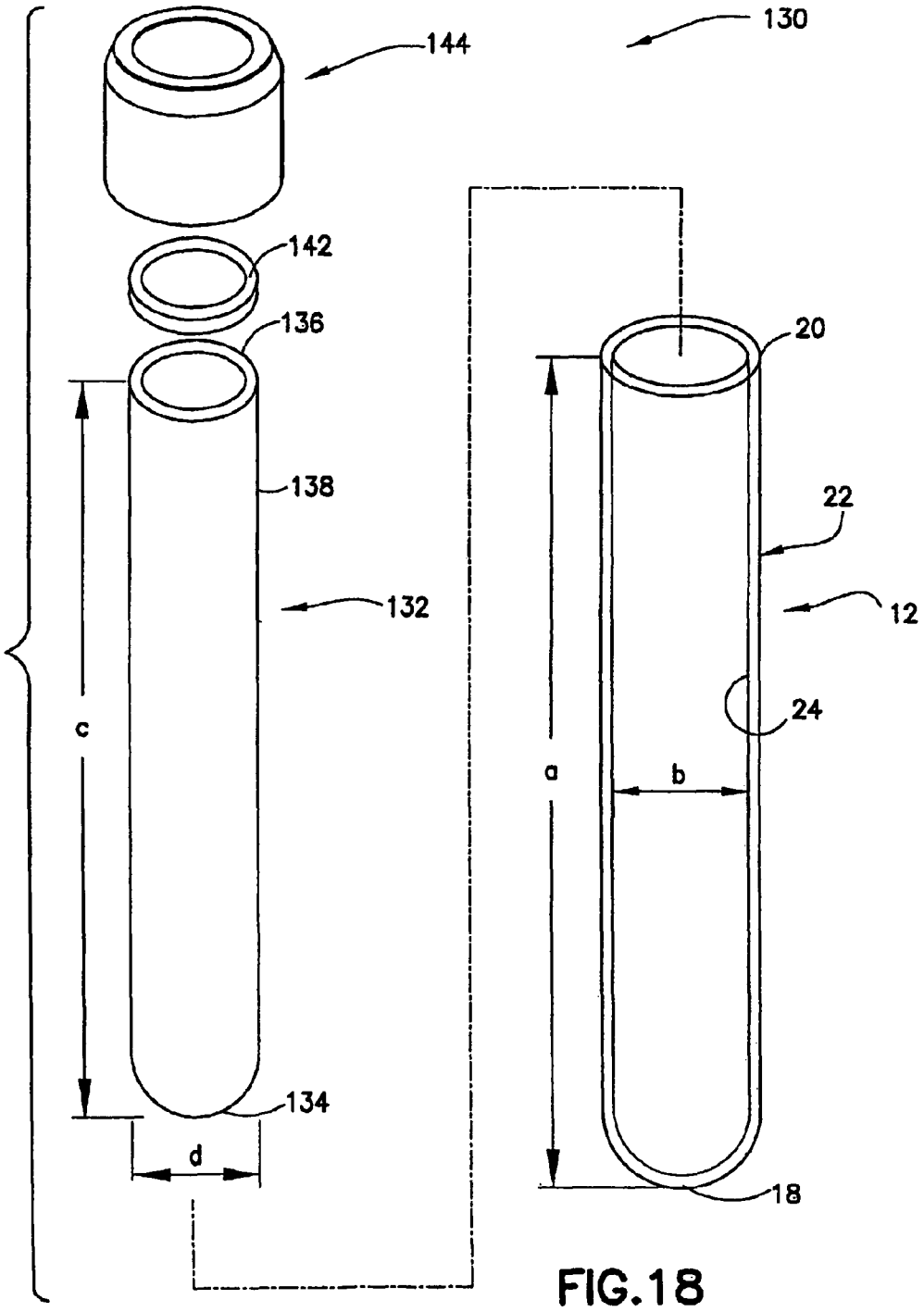
FIG. 18 is an exploded perspective view of a tube assembly in accordance with a sixth embodiment of the invention.
Figure 19:
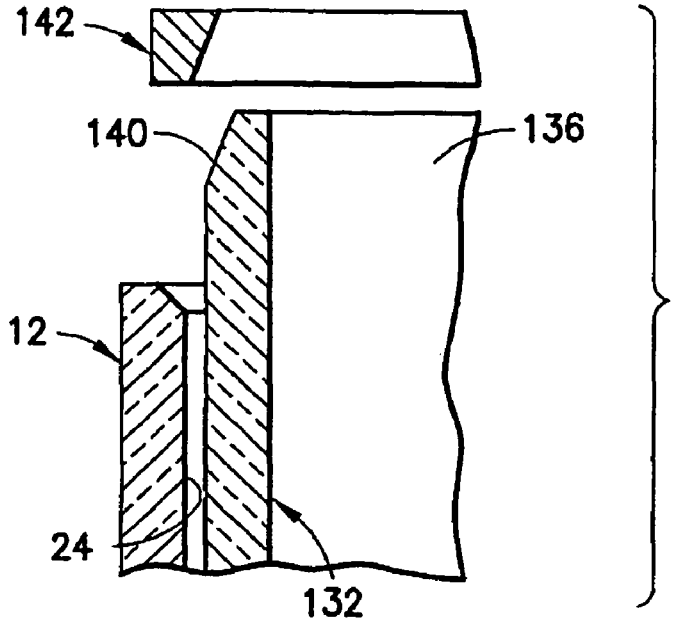
FIG. 19 is an exploded cross-sectional view showing the tubes and retaining ring during assembly.
Figure 20:
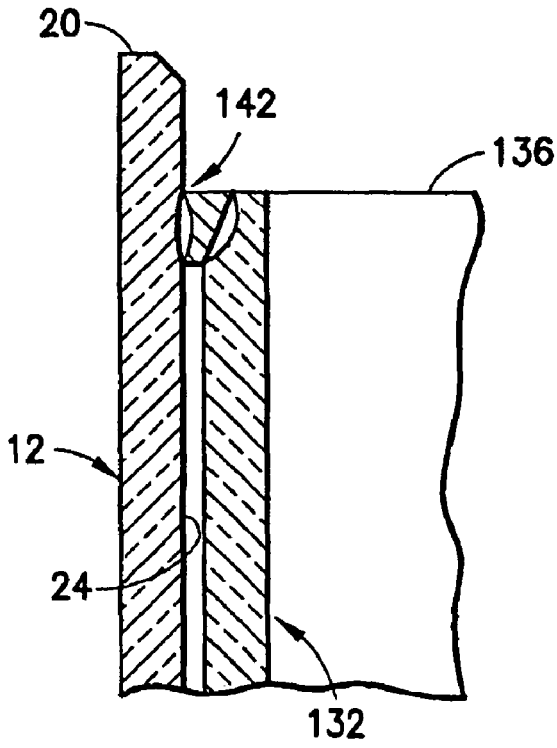
FIG. 20 is a cross-sectional view similar to FIG. 19, but showing the tubes and retaining ring in their fully assembled condition.
Figure 21:
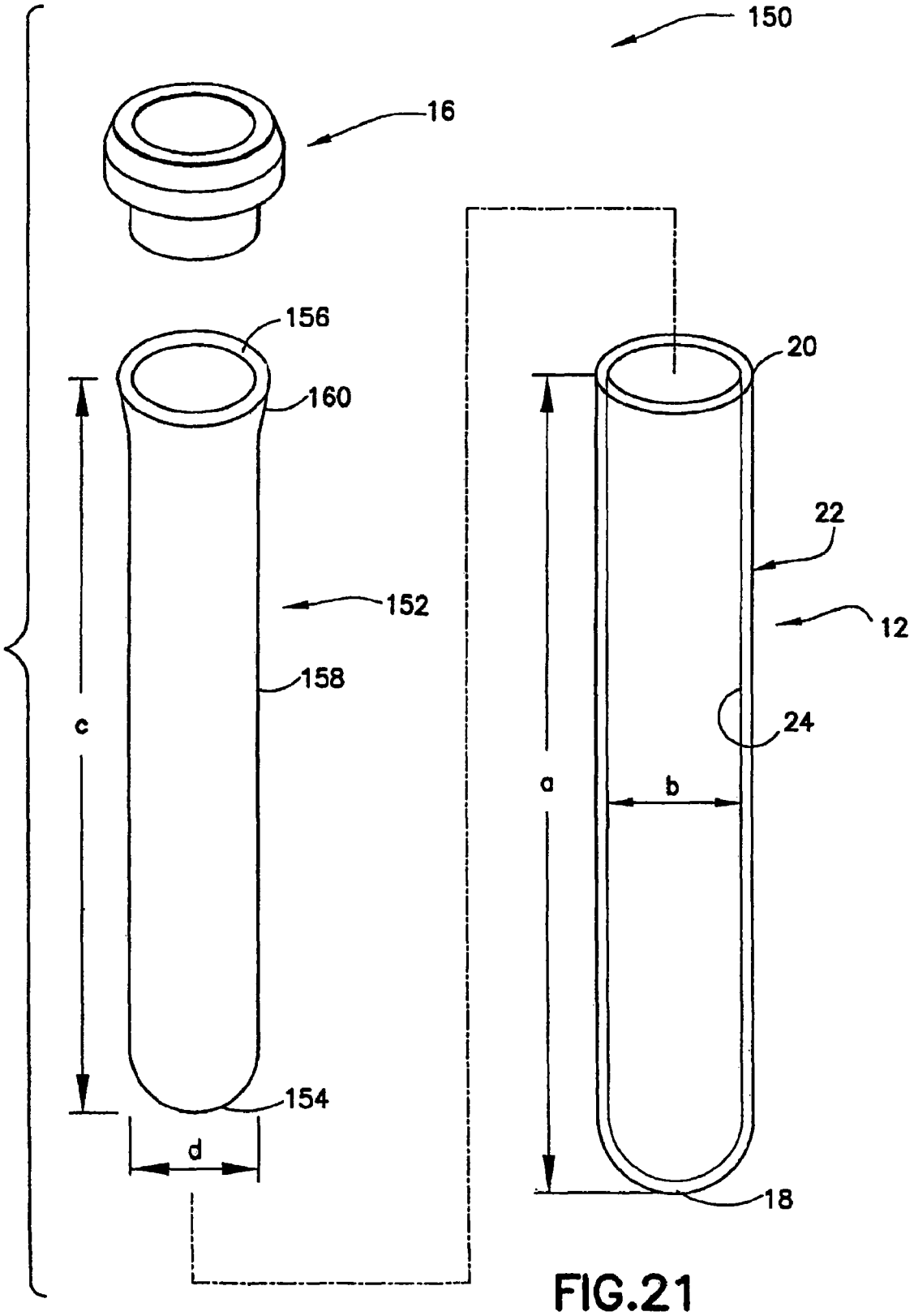
FIG. 21 is an exploded perspective view of a tube assembly in accordance with a fifth embodiment of the invention.

A further embodiment of the container assembly of the subject invention is identified generally by the numeral 130 in FIGS. 18-20. Assembly 130 includes an outer tube 12 substantially identical to the outer tubes described and illustrated with respect to the previous embodiments. Assembly 130 further includes an inner tube 132 with a closed bottom 134, an open top 136 and a tubular side wall 138 extending therebetween. Side wall 138 defines an outside diameter "d" that is less than inside diameter "b" of side wall 22 on outer tube 12. Accordingly, inner tube 132 can be inserted easily into outer tube 12 without creating an enclosed space of compressed air between inner and outer tubes 132 and 12. Portions of inner tube 132 adjacent open top 36 define a chamfered outer edge 140.

Container assembly 130 further includes a retaining ring 142. Retaining ring 142 is dimensioned to fit in the annular generally V-shaped space defined between inner surface 24 of outer tube 12 and chamfer 140 at open top 136 of inner tube 132. As shown most clearly in FIG. 19, retaining ring 142 may have a generally V-shaped cross-section to match the shape defined by chamfer 140. Container assembly 130 further includes a closure 144 that may be the same as or similar to closures described and illustrated above.

Container assembly 130 is assembled by telescoping inner tube 132 into open top 20 of outer tube 12. The relative dimensions permits an easy escape of air from outer tube 12 as inner tube 132 is being inserted. A small annular space will be defined between inner tube 132 and outer tube 112 after complete insertion of inner tube 132. Air in this space will be substantially at ambient pressure. The space between inner and outer tubes 132 and 12 can be sealed by mounting retaining ring 142 onto chamfer 140. Thus, retaining ring seals 142 against chamfer 140 and against inner circumferential surface 24 of tubular side wall 22 on outer tube 12. Retaining ring 142 can be friction welded in position to provide a substantially hermetic seal of the annular space between inner tube 132 and outer tube 12. Closure 144 then can be urged into the open tops 20 and 136 substantially as with the previous embodiments.

Figure 22:
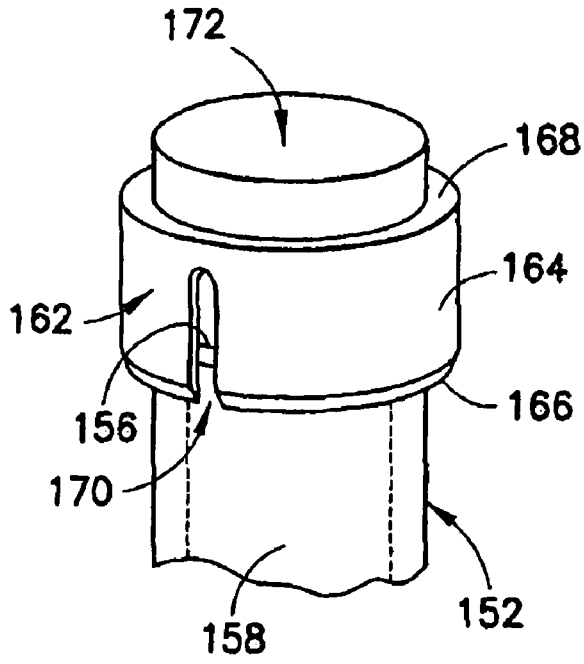
FIG. 22 is a perspective view of the tube shown in FIG. 21 during assembly.
Figure 23:
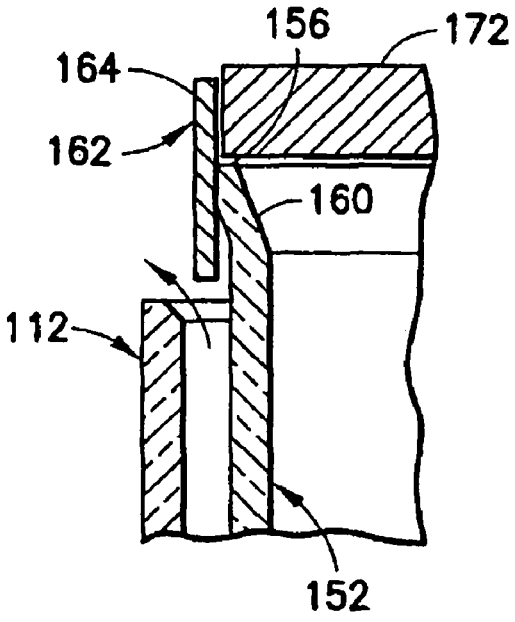
FIG. 23 is a cross-sectional view taken along line 23-23 in FIG. 22.

A further alternate of the subject container assembly is identified generally by the numeral 150 in FIGS. 21-24. Container assembly 150 includes an outer tube 12 substantially as described and illustrated in the previous embodiments. Container assembly 150 further includes an inner tube 152 with a closed bottom 154, an open top 156 and a tubular side wall 158 extending between closed bottom 154 and open top 156. Side wall 158 defines an outside diameter along most of its length that is less than inside diameter "b" of inner surface 24 of outer tube 12. Thus, inner tube 152 can be urged along most of its length into outer tube 12 of permitting a convenient escape of air. However, side wall 158 of inner tube 152 includes a flared top 160 with an outside diameter approximately equal to the inside diameter "b" of outer tube 12. Thus, inner tube 152 would tend to compress air in the annular space between inner and outer tube 152 and 12 as inner tube 152 is urged into its final nested position. However, outer tube 152 is assembled into outer tube 12 with an assembly venting device 162, as shown in FIGS. 22 and 23. Assembly venting device 162 includes a tubular body 164 with an outside diameter approximately equal to inside diameter "b" of outer tube 12. Tubular body 164 includes a bottom end 166 and a top end 168. A vent 170 extends from bottom end 166 of tubular body 164 to a location at or near top end 168. Assembly venting device 162 further includes a plunger 172 dimensioned to telescope within tubular body 164.

Figure 24:
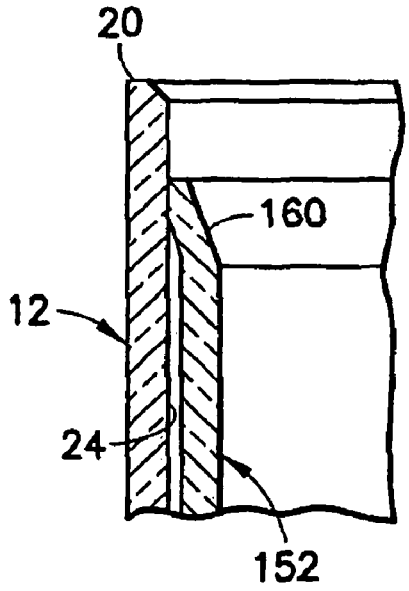
FIG. 24 is a cross-sectional view similar to FIG. 23, showing the tubes after complete assembly.

Assembly venting device 162 is used by first telescoping tubular body 164 over inner tube 152, as shown in FIG. 22. This telescoped mounting will cause flare 160 to be biased inwardly. The mounting of tubular body 164 on inner tube 152 is carried out such that the top end of vent 170 is above top end 156 of inner tube 152. Plunger 172 of assembly venting device 162 then is telescoped into top end 168 of tubular body 164 so that the bottom end of plunger 172 abuts against open top 156 of inner tube 152. Inner tube 152 and assembly venting device 162 then are telescoped into open top 20 of outer tube 12. Air in outer tube 12 initially escapes through the annular space between inner tube 152 and outer tube 12 as shown schematically in FIG. 23. Further insertion, however, will urge bottom end 166 of tubular body 164 into open top 20 of outer tube 12. Thus, the outflow of air will be impeded somewhat. However, further airflow is permitted through vent 170. Assembly venting device 162 and inner tube 152 are moved further into outer tube 12 until inner tube 152 is fully nested within outer tube 12. Tubular body 164 then is withdrawn upwardly relative to plunger 172 and relative to inner tube 152. Sufficient upward movement of tubular body 164 causes bottom end 166 of tubular body 164 to clear flared section 160 of side wall 158 on inner tube 152. Hence, flare 160 will resiliently expand into an interference fit with inner surface 24 of outer tube 12, as shown in FIG. 24. Plunger 172 then may be withdrawn upwardly, and the closure shown in FIG. 21 can be mounted on the assembled inner tube 152 and outer tube 20 as described with respect to the previous embodiments.

What is claimed is:

1. A tube assembly comprising:

an outer tube having a closed bottom and an open top;

an inner tube having a closed bottom and an open top, said inner tube being nested in said outer tube and being dimensioned to define a substantially annular space between said inner and outer tubes along at least a major portion of a length between said closed bottom and said open top of said inner tube, portions of said inner tube in proximity to said open top of said inner tube being configured to define a vent for permitting escape of air from said outer tube as said inner tube is inserted into said outer tube; and a closure engageable with at least said outer tube and configured for closing the vent.

2. The tube assembly of claim 1, wherein said inner tube has an outward flare substantially adjacent said open top dimensioned for engaging said outer tube and substantially closing said annular space between said inner and outer tubes, said vent comprising at least one opening formed through said outward flare of said inner tube, said closure being dimensioned for closing said opening.

3. The tube assembly of claim 1, wherein the closure includes a bead in said annular space at a location in proximity to said open top of said inner tube, said vent being formed through said bead, said bead being sufficiently deformable for closing said vent.

4. The tube assembly of claim 3, wherein said bead is fusable to said outer tube for substantially sealing said annular space.

5. The tube assembly of claim 3, wherein said bead is formed integrally with said inner tube.

6. The tube assembly of claim 1, wherein said outer tube has a tubular sidewall extending between said closed bottom and said open top, said tubular sidewall of said outer tube having an inner surface spaced from said inner tube at locations adjacent said open top of said inner tube for defining said vent, said closure including an inner tube closure telescoped into said open top of said inner tube, a shoulder extending from said inner tube closure to said inner surface of said outer tube for sealing said annular space between said inner and outer tubes and an outer tube closure telescoped into said open top of said outer tube for sealing engagement with said inner surface of said tubular sidewall of said outer tube.

7. The tube assembly of claim 6, wherein a portion of said shoulder is telescoped into said annular space between said inner and outer tubes at locations adjacent said open top of said inner tube.

8. The tube assembly of claim 1, wherein said inner tube includes a weakened region at a location in proximity to said open top, said closure being telescoped into said open tops of said inner and outer tubes and being configured for deflecting outwardly portions of said inner tube between said weakened region and said open top of said inner tube, such that portions of said inner tube between said weakened region and said open top of said inner tube are urged into engagement with said outer tube for closing said vent.

9. The tube assembly of claim 8, wherein said weakened region of said inner tube is substantially annular and extends substantially completely around said inner tube.

10. The tube assembly of claim 9, wherein said weakened region of said inner tube defines a region of reduced thickness.

11. The tube assembly of claim 10, wherein said area of reduced thickness is defined by a groove in at least one of inner and outer surfaces of said inner tube.

12. The tube assembly of claim 11, wherein each of said inner and outer surfaces of said inner tube includes an annular groove for defining said area of reduced thickness.

13. The tube assembly of claim 1, wherein said closure includes a retaining ring telescoped into said annular space between said inner and outer tubes at a location substantially adjacent said open top of said inner tube, said closure further including a stopper telescoped into said open top of at least said outer tube.

14. The tube assembly of claim 13, wherein said inner tube includes an outer surface and a chamfer on said outer surface adjacent said open top, such that said retaining ring is guided into said annular space between said inner and outer tubes by said chamfer adjacent said open top of said inner tube.

15. The tube assembly of claim 14, wherein said retaining ring has opposite top and bottom annular ends, said bottom annular end of said retaining ring being tapered to a smaller radial dimension than said top end of said retaining ring for facilitating mounting said retaining ring in said annular space between said inner and outer tubes.

16. The tube assembly of claim 1, wherein said outer tube is formed from a first type of plastic material and the inner tube is formed from a second type of plastic material different from said first type.

17. A tube assembly comprising:

an outer tube with a closed bottom, an open top and a tubular sidewall extending between said bottom and said top;

an inner tube having a closed bottom, an open top and a tubular sidewall extending between said closed bottom and said open top, at least portions of said tubular sidewall of said inner tube being spaced from said tubular sidewall of said outer tube for defining a substantially annular space between said inner and outer tubes, portions of said tubular sidewall of said inner tube in proximity to said open top being deflectable from a first condition where said inner tube permits venting of air from said substantially annular space between said inner and outer tubes and a second position where portions of said inner tube adjacent said open top engage said tubular sidewall of said outer tube.

18. The tube assembly of claim 17, wherein said tubular sidewall of said inner tube includes a weakened region in proximity to said open top and wherein said tube assembly further includes a closure configured for telescoping into said open top of said inner tube and for deflecting portions of said inner tube above said weakened region outwardly and into engagement with said tubular sidewall of said outer tube for substantially closing said annular space.

19. The tube assembly of claim 17, wherein portions of said tubular sidewall of said inner tube in proximity to said open top define an outward flare dimensioned for engagement with said tubular sidewall of said outer tube, said inner tube being formed from a resiliently deflectable material for deflecting said outward flare inwardly sufficiently to permit venting of air from said substantially annular space when said inner tube is being inserted into said outer tube.

20. A method for assembling a tube assembly comprising:

providing an outer tube formed from a first plastic material, said outer tube having a closed bottom, an open top and a tubular sidewall defining an inside diameter;

providing an inner tube formed from a second plastic material different from said first plastic material, said inner tube having a closed bottom, an open top and a tubular sidewall defining outside diameter less than said inside diameter of said tubular sidewall of said outer tube so as to create a substantially annular space between said inner and outer tubes upon insertion of said inner tube into said outer tube, portions of said tubular sidewall of said inner tube in proximity to said open top of said inner tube being dimensioned and configured to define a vent;

inserting said inner tube into said open top of said outer tube while permitting air within said space between said inner and outer tubes to be vented through said vent; and inserting at least one closure into at least the open top of the outer tube for closing the open tops of the inner and outer tubes and for closing said vent.

21. The method of claim 20, wherein the tubular sidewall of said inner tube includes an outward flare adjacent said top end for sealing engagement with said tubular sidewall of said inner tube, said vent including an aperture formed in the outward flare, said step of inserting said closure including inserting said closure sufficiently into said open top of said inner tube for covering said aperture.

22. The method of claim 20, wherein the step of inserting said closure includes inserting said closure sufficiently to engage both said open top of said inner tube and said tubular sidewall of said outer tube.

23. The method of claim 22, wherein the step of inserting said closure includes inserting said closure at least partly into an annular space between said open top of said inner tube and said tubular sidewall of said outer tube.

24. The method of claim 20, wherein said step of inserting said closure includes inserting said closure sufficiently to deflect portions of said tubular sidewall of said inner tube outwardly and into engagement with said tubular sidewall of said outer tube.

25. The method of claim 20, wherein portions of said inner tube adjacent said open top define an outward flare with an outer diameter at least equal to said inside diameter of said tubular sidewall of said outer tube, said method further comprising deflecting said outward flare of said inner tube inwardly sufficiently for said venting during said step of inserting of said inner tube into said outer tube, said method further comprising permitting said inner tube to return resiliently to an undeflected condition after said inner tube is inserted into said outer tube such that said outward flare of said inner tube engages said tubular sidewall of said outer tube.

26. The method of claim 25, wherein the step of deflecting said outward flare of said inner tube comprises providing a tubular collar with an outside diameter no greater than said inside diameter of the outer tube and an inside diameter sufficiently small for deflecting said outward flare of said inner tube inwardly, said collar further including at least one vent opening, said method further including telescoping said collar over said outward flare of said inner tube, inserting said inner tube and said collar into said outer tube such that air between said inner and outer tube is vented through said vent opening of said collar, and separating said collar from said inner and outer tubes.

27. The method of claim 26, wherein the step of separating the collar comprises inserting a plunger into said collar and against said open top of said inner tube, and moving said collar and said plunger in opposite directions for separating said collar from said inner and outer tubes.

28. The method of claim 20, wherein the step of providing an inner tube comprises providing an inner tube with a bead extending partly around an outer circumferential surface of said tubular sidewall of said inner tube, said bead defining an outside diameter approximately equal to said inside diameter of said tubular sidewall of said outer tube, said bead including at least one vent opening for permitting said venting during said step of inserting said inner tube, said method further comprising deforming said bead sufficiently for closing said vent opening.

29. The method of claim 28, wherein the step of deforming comprises rotating said inner tube and said bead relative to said outer tube.

* * * * *